US005575094A

United States Patent [19]

Leake et al.

[11] Patent Number: 5,575,094

[45] Date of Patent: Nov. 19, 1996

[54] GREETING CARD AND PICTURE FRAME COMBINATION

[76] Inventors: Michael J. Leake, 6740 Rodeo Rd., Palos Verdes,, Calif. 90274; Albert O. Cota, 17475 Flanders St., Granda Hills, Calif. 91344

[21] Appl. No.: 139,508

[22] Filed: Oct. 19, 1993

[51] Int. Cl.[6] ..... G09F 1/00

[52] U.S. Cl. ..... 40/124.1; 40/725; 40/748; 40/746

[58] Field of Search ..... 40/124.1, 152, 40/152.1, 725, 748, 746

[56] References Cited

U.S. PATENT DOCUMENTS

| | | | |
|---|---|---|---|
| 3,234,676 | 2/1966 | Colicki et al. | 40/124.1 |
| 5,081,776 | 1/1992 | Stone et al. | 40/124.1 |
| 5,253,440 | 10/1993 | Cheng | 40/152.1 |
| 5,303,489 | 4/1994 | Blesen | 40/152 |
| 5,375,351 | 12/1994 | King et al. | 40/124.1 |

FOREIGN PATENT DOCUMENTS

| | | | |
|---|---|---|---|
| 1400002 | 7/1975 | United Kingdom | 40/124.1 |

*Primary Examiner*—Kenneth J. Dorner
*Assistant Examiner*—Cassandra Davis
*Attorney, Agent, or Firm*—Albert O. Cota

[57] ABSTRACT

A greeting card and picture frame combination (10) that consist of a greeting card (12) and a picture frame assembly (50). The card includes a front cover (14) having a front surface (16) that includes indicia (20) and a foldable back section (22). The picture frame assembly (50) includes a picture frame (52) having a front side (54), an inner longitudinal member (56), a back surface (58) and a lower member (64). The foldable back section (22) is attached to back surface (58) of the picture frame's inner longitudinal member (56). When the foldable back section (22) of the card (12) is extended outward, away from the back surface (58) of the picture frame (52), the lower edges of the card's front cover (14) and the lower member (64) of the picture frame (52) can be placed on a horizontal surface to allow both the front cover (14) and the front side (54) of the picture frame to be viewed. The combination (10) may also be assembled with a pocket section (86) that allows the card (12) to be easily removed from the picture frame (52) to allow the card and the picture frame to be viewed and handled as separate items.

1 Claim, 3 Drawing Sheets

GREETING CARD AND PICTURE FRAME COMBINATION

TECHNICAL FIELD

The invention pertains to the general field of greeting cards and picture frames and mope particularly to a gift item that combines in a single package both the greeting card and the picture frame.

BACKGROUND ART

The giving of greeting cards and gifts has long been used and accepted by both individuals and businesses as an expression of love, thanks and condolence. Cards are also commonly used to make various types of announcements, such as for new products, graduations, birthdays and marriages and are also given at various seasonal holidays. In general, to enhance the significance of the occasion, a person of a company often gives both a greeting card and a gift such as a picture frame as separate items.

A search of the prior art was conducted in several department stores, specialty stores, drug stores, catalogs and business gift companies to determine what types, combinations and design configurations of greeting cards and picture frames were available. This search disclosed that there were no greeting cards that were integrated with a picture frame to function as a single combination gift. Further, no such gift was found where the frame could be held upright by either the card or an integrated frame stand or combination of both the card and frame stand. Thus, the prior art did not disclose any items that read directly on the claims of the instant invention.

DISCLOSURE OF THE INVENTION

The greeting card and picture frame combination also known as a PhotoFrame™ card allows a person to give in a single package both a greeting card and a gift which in this case, the gift is a personalized picture in a frame. In its most basic form, the invention consists of two major elements:

a) a greeting card having a front cover with a front surface that includes indicia such as a loving or seasonal greeting, and a foldable back section, that may also include indicia and b) a picture frame which includes a personalized picture, a front side and a back side. The foldable back section of the greeting card, which has a width equal to the width of a frame member, is attached by an attachment means such as an adhesive, to the back surface of the picture frame.

When the greeting card is moved outward, that is, away from the back surface of the picture frame, the bottom edges of the greeting card and the picture frame allow the combination to be placed on a horizontal surface. When so placed, the front cover of the greeting card and the front side of the picture frame which displays the personalized picture, can be viewed together. The design of the combination greeting card and picture frame allows the greeting card to be removed and displayed separately if so desired.

The invention also discloses an optional design that uses a pocket structure having a side pocket, an outer section and an inner section. The inner section is sized to be attached by an adhesive to the back surfaces of the outer perimeter of the frame members. When the foldable back section of the greeting card is inserted into the pocket and thereafter extended outwardly, the card and picture frame can be placed on a horizontal surface for display. This design also allows the card to be removed from the pocket and displayed separately from the picture frame.

In view of the above disclosure, it is the primary object of the invention to produce a Photo Frame™ card that provides in a single package, a combination personalized greeting card and picture frame.

In addition to the primary object, it is also an object of the invention to provide a gift item that:

- is aesthetic,
- is different from available personal and business greeting cards,
- can be made with an endless combination of phrases, symbols and pictures,
- allows the card to be detached from the frame to be used separately or allows the card to remain attached to the frame to hold-up the frame,
- allows the image on the card and frame to be viewed simultaneously,
- has applicability fop commercial advertising as well as gift giving,
- is sized to be mailed,
- is cost effective from both a manufacturer and consumer points of view.

These and other objects and advantages of the present invention will become apparent from the subsequent detailed description of the preferred embodiment and the appended claims taken in conjunction with the accompanying drawings.

BEST MODE FOR CARRYING OUT THE INVENTION

The best mode for carrying out the invention is presented in terms of a preferred embodiment that is designed to provide in a single item, both a greeting card and a gift such as a picture frame. The preferred embodiment of the greeting card and picture frame combination 10 as shown in FIGS. 1–8 is comprised of two major elements: a greeting card 12 and a picture frame 52. The complete assembled combination 10 is shown in perspective in FIGS. 1 and 2 and in an elevational view in FIG. 6.

Figure 1:
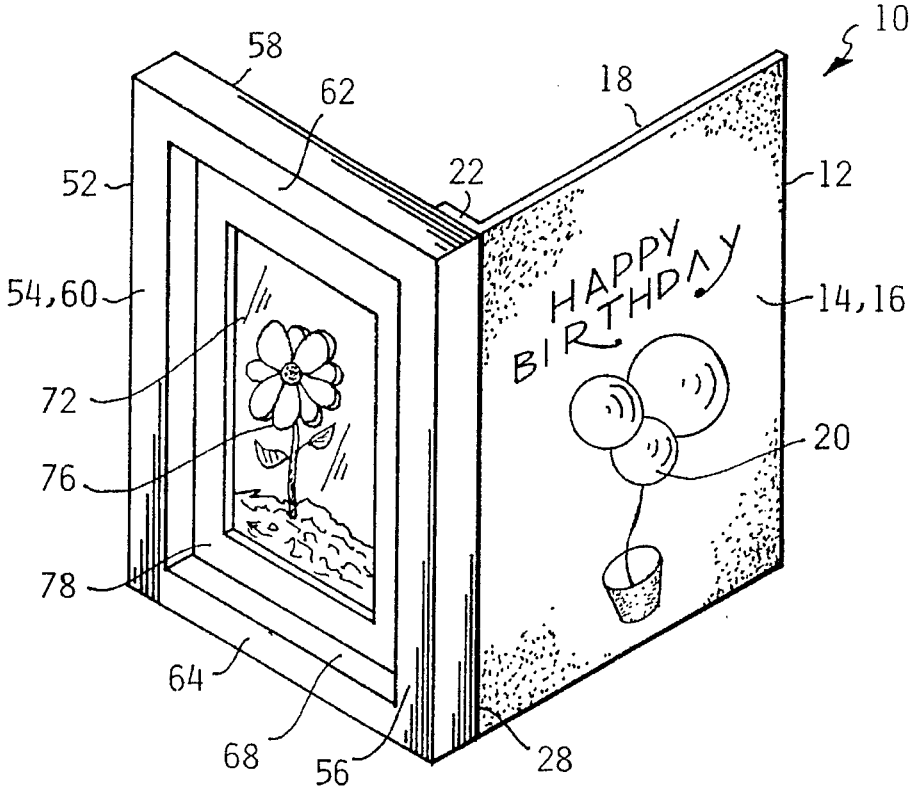
FIG. 1 is a perspective front view of the greeting card and picture frame combination.
Figure 2:
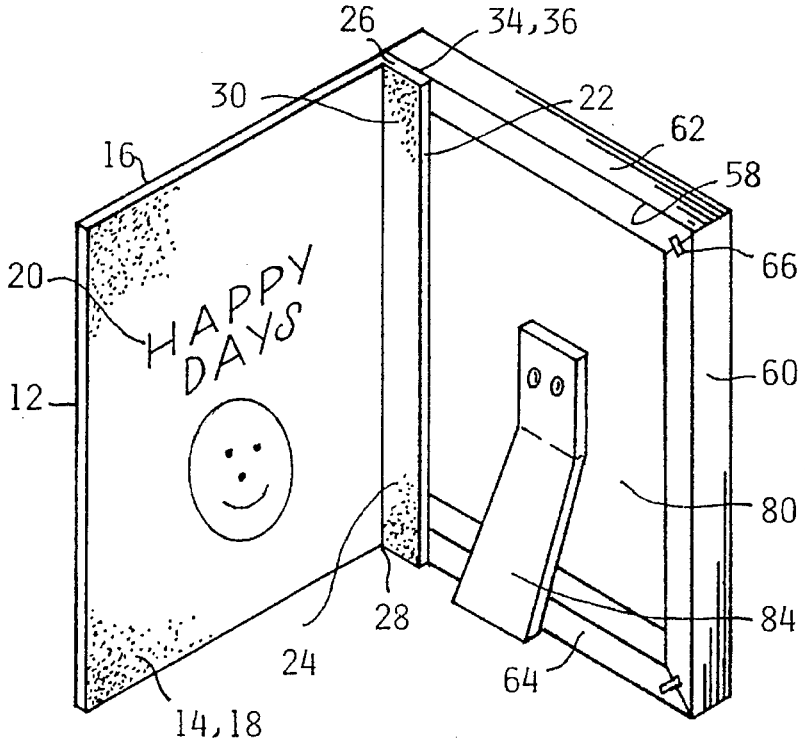
FIG. 2 is a perspective back view of the greeting card and picture frame combination.
Figure 3:
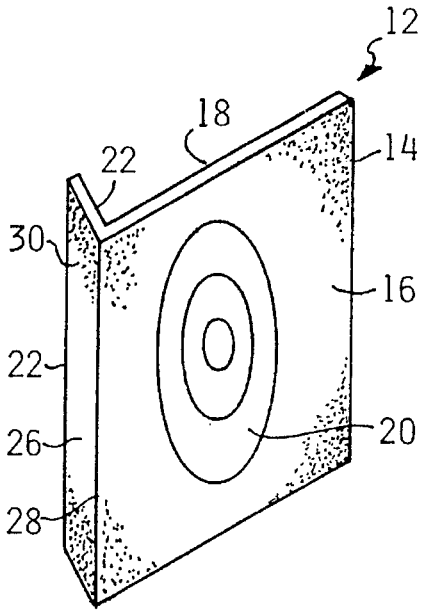
FIG. 3 is a perspective front view of the greeting card.
Figure 4:
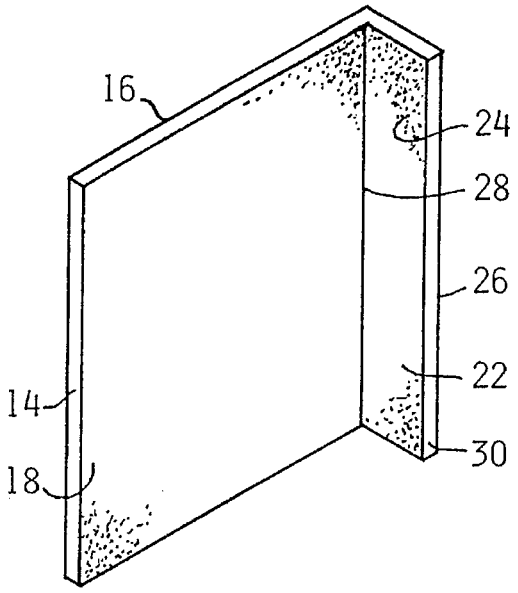
FIG. 4 is a perspective back view of the greeting card.

The greeting card 12 is shown attached to the frame assembly in FIGS. 1 and 2 and as separated elements in FIGS. 3 and 4. The card 12 is comprised of front cover 14 that has a front surface 16 and a back surface 18. The front surface 16 normally includes indicia 20 such as a greeting with art work as shown in FIG. 3; the back surface 18 as shown in FIG. 2, may also include indicia 20. The card also includes a foldable back section 22 having a front surface 24 and a back surface 26. The front cover 14 and foldable back section 22 are integrally and foldably retained by means of an internal groove which functions as a living hinge 28. The foldable back section 22 in the preferred embodiment consists of a longitudinal tab as best shown in FIGS. 3 and 4.

Figure 5:
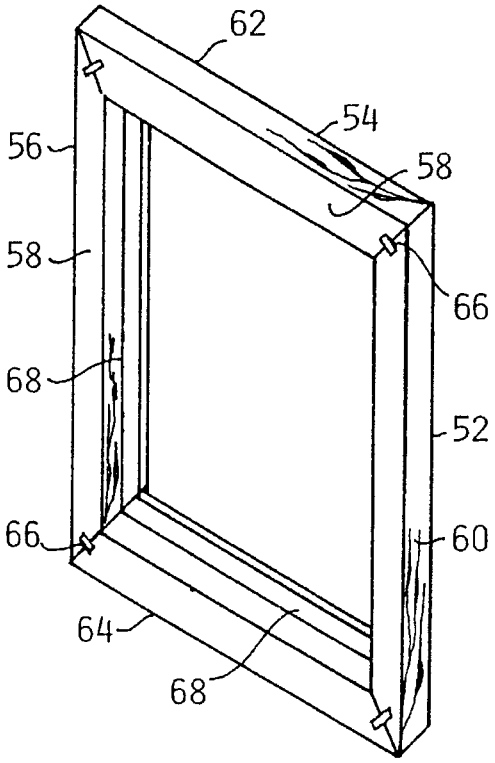
FIG. 5 is a perspective back view of the picture frame.

The second element of the invention is the picture frame assembly 50 as shown in FIGS. 1, 2 and 5. The frame assembly is comprised of a picture frame 52 consisting of a front side 54 that is, the viewing side, an inner longitudinal member 56 having a back surface 58, an outer longitudinal member 60, an upper member 62 and a lower member 64. The lower and upper members 62,64 are attached by an attachment means to the inner and outer longitudinal members 56,60. Preferably the frame attachment means consists of a plurality of U-nails 66 that are inserted at each frame corner as best shown in FIG. 5. Around the inner perimeter of the frame 52 as also shown in FIG. 5 is a perimeter lip 68.

Figure 6:
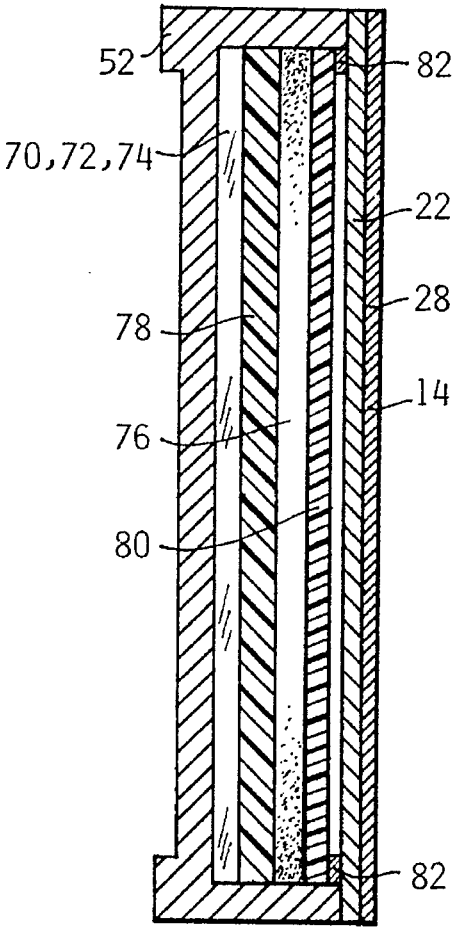
FIG. 6 is a side elevational view of the greeting card and picture frame combination.

Into the assembled picture frame 52 as shown in FIG. 6, is inserted in sequence, a transparent member 70 that may be made of glass 72 or a plastic such as lucite 74 that is held within the frame by means of the lip 68. Over the member 70 is inserted a picture 76 that faces outward to allow the picture to be viewed from the front side 54 of the picture frame 52. If desired or if the picture needs cropping, a picture matt 78 may be inserted into the frame between the transparent member 70 add the picture 76 as also shown in FIG. 6. The final element inserted into the back of the picture frame 52 is a frame backing 80 that interfaces with the back surface of the picture 76. The backing 80 is secured to tile frame member by a securing means that preferably consists of an plurality of tabs 82 that are partially pressed into the sides of the frame member. A portion of the tabs extend outward to hold the frame backing 80 in place and to complete the picture frame assembly 50.

The greeting card and picture frame combination 10 is assembled by attaching the back surface 26, of the foldable back section 22 of the greeting card 12 to the back surface 58 of the inner longitudinal member 56 of the picture frame 52. When so attached, the front cover 14 of the card 12 can be moved outward, that is away from the back surface 58, to allow the lower edges of the greeting card and picture frame combination 10 to be placed on a horizontal surface. In this position, the front surface 16 of the front cover 14 and the front side of 54 of the picture frame 52 can be viewed as shown in FIG. 1.

Two designs for the foldable back section 22 are disclosed. In the preferred design, the foldable back section 22 consists of a longitudinal tab 30 as shown best in FIGS. 3 and 4. In this design, the tab has a width substantially equal to the width of the inner longitudinal member 56 of the frame 50. The tab 30 has a back surface 26 that is attached by an attachment means 34 to the back surface 58 of the inner longitudinal member 56. The preferred attachment means is a permanent adhesive 36.

Figure 7:
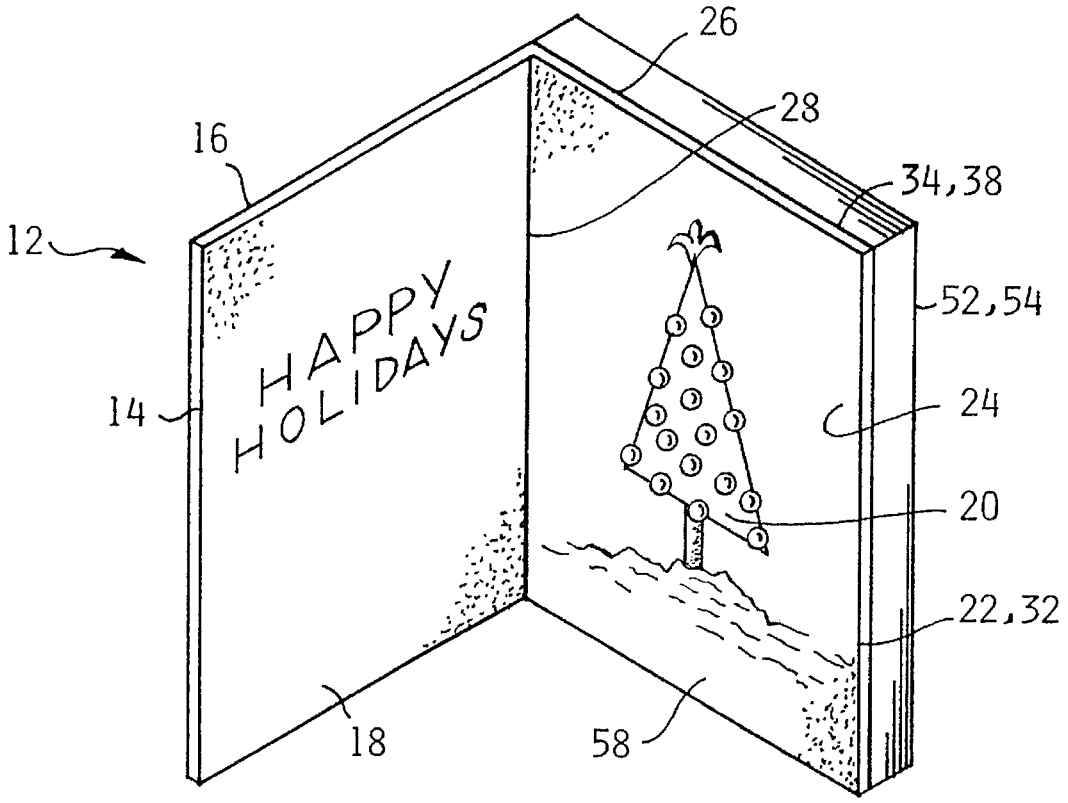
FIG. 7 is a perspective back view of the greeting card and picture frame combination with a full size foldable back section.

In the second design, the foldable back section 22 is dimensioned to fit over and be attached by an attachment means 34 to the outer perimeter of the four members that comprise the picture frame 52. When the second design is used, the front surface 24 of the back section 22 may also include indicia 20 as shown in FIG. 7. Also, in the second design, the attachment means 34 consists of a contact adhesive 38 which allows the greeting card to be removed without marring the greeting card 12 or the picture frame 52. Thus, allowing the independent display of each item.

In both designs, but preferably in the preferred design, the frame backing 80 may include a pullout frame stand 84 as shown in FIG. 2. The pullout stand is primarily used when the picture frame is displayed apart from the greeting card 12.

Figure 8:
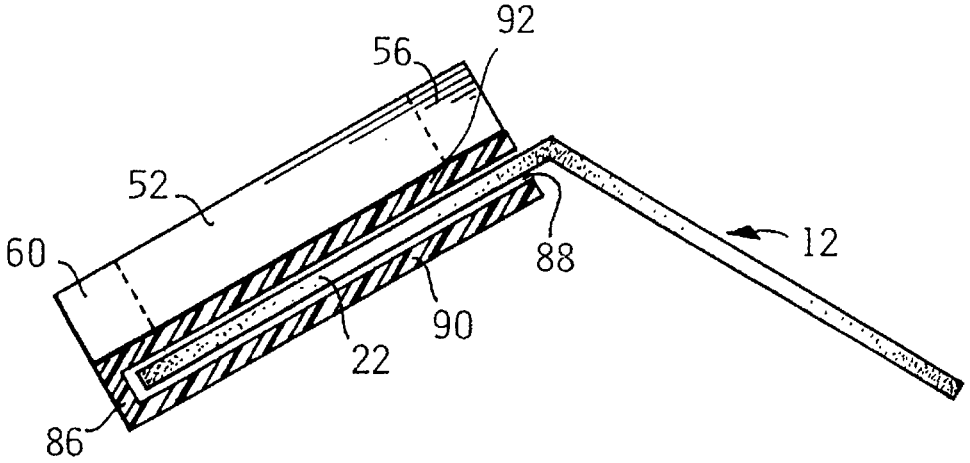
FIG. 8 is a top plan view of a picture frame having attached a pocket section into which is inserted the foldable back section of a greeting card.

The final optional element that may be included with the greeting card and picture frame combination 10 is a pocket structure 86. The structure includes a pocket 88, an outer section 90 and an inner section 92. The inner section 92 is sized to be attached by an attachment means such as an adhesive, to the outer perimeter back surfaces of the frame members 56,60,62,64 as shown in FIG. 8. When so attached, the pocket 88 extends longitudinal from the edge of the longitudinal member 56 to allow the foldable back section 22 of the greeting card 12 to be inserted therein. When the card is so inserted and opened as shown in FIG. 8, the card 12 and the picture frame assembly 50 can be viewed as a single unit or, the card can be easily removed to allow the card 12 and picture frame assembly to be displayed separately.

While the invention has been described in complete detail and pictorially shown in the accompanying drawings it is not to be limited to such details, since many changes and modifications may be made in the invention without departing from the spirit and scope thereof. hence, it is described to cover any and all modifications and forms which may come within the language and scope of the appended claims.

We claim:

1. A greeting card and picture frame combination comprising:

A. a greeting card having:
  (1) a front cover having a front surface and a back surface,
  (2) a foldable back section having a front surface and a back surface,
  (3) a living hinge that foldably retains the front cover to the back section, B. a picture frame assembly comprising:
  a) a picture frame further comprising:
    (1) a front side,
    (2) an inner longitudinal member having a back surface,
    (3) an outer longitudinal member,
    (4) an upper member and
    (5) a lower member, where the upper and lower members are attached by an attachment means to the inner and outer longitudinal members respectively and where the inner, outer, upper and lower members define said picture frame having a central opening with an inner perimeter,
    (6) a perimeter lip cut into the inner perimeter of said picture frame,
  b) a transparent member inserted into said picture frame and held within said frame by means of the perimeter lip,
  c) a picture facing toward the front side of said picture frame and inserted into said frame over the transparent member where the picture is viewed from the front side of said frame,
  d) a frame backing inserted into said frame over the picture,
  e) means for securing the frame backing to said picture frame, and C. means for attaching the back surface of the foldable back section of said greeting card to the back surface of the inner longitudinal member of said frame, where when so attached, said front cover can be moved outward away from the back surface of said frame assembly to allow said greeting card and picture frame combination to be placed on a horizontal surface to allow the front surface of the front cover and the front side of the picture frame to be viewed wherein the back section of said greeting card further consists of a longitudinal tab having a width substantially equal to the width of the inner longitudinal member of said frame, where the longitudinal tab has a back surface that is attached by an attachment means to the back surface of the inner longitudinal member of said picture frame.

* * * * *